US005894317A

United States Patent [19]

Usui et al.

[11] Patent Number: 5,894,317

[45] Date of Patent: Apr. 13, 1999

[54] DROP-ON-DEMAND INK-JET PRINTING HEAD

[75] Inventors: Minoru Usui; Haruhiko Koto; Haruo Nakamura; Yozo Shimada; Tomoaki Abe, all of Nagano, Japan

[73] Assignee: Seiko Epson Corporation, Tokyo, Japan

[ * ] Notice: This patent is subject to a terminal disclaimer.

[21] Appl. No.: 08/794,017

[22] Filed: Feb. 3, 1997

Related U.S. Application Data

[63] Continuation of application No. 08/393,920, Feb. 24, 1995, which is a continuation of application No. 08/136,049, Oct. 14, 1993, Pat. No. 5,444,471, which is a continuation of application No. 07/657,910, Feb. 20, 1991, abandoned.

[30] Foreign Application Priority Data

| | | | |
|---|---|---|---|
| Feb. 23, 1990 | [JP] | Japan | 2-4074 |
| Nov. 30, 1990 | [JP] | Japan | 2-337278 |

[51] Int. Cl.[6] ..... B41J 2/045

[52] U.S. Cl. ..... 347/72

[58] Field of Search ..... 347/71, 72, 68, 347/70; 310/328, 333

[56] References Cited

U.S. PATENT DOCUMENTS

| | | | |
|---|---|---|---|
| 4,072,959 | 2/1978 | Elmvist | 347/68 |
| 4,390,886 | 6/1983 | Sultan | 347/68 |
| 4,439,780 | 3/1984 | DeYoung et al. | 347/68 |
| 4,523,121 | 6/1985 | Takahashi et al. | 310/334 |
| 4,536,097 | 8/1985 | Nilsson | 347/68 |
| 4,566,018 | 1/1986 | Nilsson | 310/330 |
| 4,599,628 | 7/1986 | Doring et al. | 347/71 |
| 4,638,206 | 1/1987 | Tsunooka et al. | 310/313 B |

(List continued on next page.)

FOREIGN PATENT DOCUMENTS

| | | |
|---|---|---|
| 0 372 521 | 6/1990 | European Pat. Off. . |
| 0 402 171 | 6/1990 | European Pat. Off. . |

(List continued on next page.)

OTHER PUBLICATIONS

Patent Abstracts of Japan, vol. 11, No. 94, Mar. 25, 1987, corresponding to JPA-61 246 063 (Ricoh Co. Ltd.) Nov. 1, 1986.

Utsumi et al., "Designed-Space Forming Technology In Ceramics" IMC 1986 Proceedings, May 1986, pp. 36-42.

*Primary Examiner*—Benjamin R. Fuller
*Assistant Examiner*—Michael Nghiem
*Attorney, Agent, or Firm*—Sughrue, Mion, Zinn, Macpeak & Seas, PLLC

[57] ABSTRACT

A drop-on-demand ink-jet printing head provided with an array of a plurality of piezoelectric elements arranged at regular intervals and fixed at their one ends to a base, the other ends of the respective piezoelectric elements being free ends which are disposed in opposition to nozzle respective apertures, the piezoelectric elements being formed by cutting, at predetermined width, a piezoelectric plate obtained by firing a lamination of paste-like piezoelectric material and conductive material stacked alternately in layers. Since each piezoelectric element is composed of a thin piezoelectric plate interposed between electrodes, if a voltage of only about 30 V, which is sufficient to drive the thin piezoelectric plate, is applied across the electrodes, it is possible to largely flex the whole of the piezoelectric element. By this transformation, ink between the top end of the piezoelectric element and the nozzle aperture is discharged to the outside as an ink drop. Because the driving voltage required for forming an ink drop is as low as possible, it is possible to simplify a driving circuit, and because of cutting a piezoelectric plate, it is possible to form small-sized piezoelectric elements with the same accuracy as in a process of producing a semiconductor.

8 Claims, 18 Drawing Sheets

U.S. PATENT DOCUMENTS

| | | | |
|---|---|---|---|
| 4,752,788 | 6/1988 | Yasuhara et al. | 347/68 |
| 4,752,789 | 6/1988 | Maltsev | 347/71 |
| 4,788,557 | 11/1988 | Howkins | 347/68 |
| 4,812,698 | 3/1989 | Chida et al. | 310/330 |
| 4,819,014 | 4/1989 | Yasuhara et al. | 347/68 |
| 4,845,399 | 7/1989 | Yasuda et al. | 310/365 X |
| 4,937,597 | 6/1990 | Yashuhara et al. | 347/71 |
| 4,962,391 | 10/1990 | Kitahara et al. | 347/47 X |
| 5,072,240 | 12/1991 | Miyazawa et al. | 347/40 X |
| 5,444,471 | 8/1995 | Usui et al. | 347/72 |
| 5,446,485 | 8/1995 | Usui et al. | 347/72 |

FOREIGN PATENT DOCUMENTS

| | | | |
|---|---|---|---|
| 56-120365 | 9/1981 | Japan | 347/72 |
| 58-10863 | 6/1983 | Japan . | |
| 58-119870 | 7/1983 | Japan . | |
| 58-119871 | 7/1983 | Japan . | |
| 58-119872 | 7/1983 | Japan . | |
| 59-152708 | 8/1984 | Japan . | |
| 60-90770 | 5/1985 | Japan . | |
| 61-46082 | 3/1986 | Japan | 310/340 |
| 61-208880 | 9/1986 | Japan . | |
| 63-125343 | 5/1988 | Japan . | |
| 63-185640 | 8/1988 | Japan . | |
| 63-295269 | 12/1988 | Japan . | |
| 63-303750 | 12/1988 | Japan | 347/72 |
| 1-115638 | 5/1989 | Japan | 347/72 |
| 1-198357 | 8/1989 | Japan | 347/72 |
| 1255549 | 12/1989 | Japan . | |
| 2-2006 | 1/1990 | Japan . | |

DROP-ON-DEMAND INK-JET PRINTING HEAD

This is a Continuation of application No. 08/393,920 filed Feb. 24, 1995, which is a Continuation of application No. 08/136,049, filed Oct. 14, 1993, U.S. Pat. No. 5,444,971 which is a File Wrapper Continuation of application No. 07/657,910, filed Feb. 20, 1991 abandoned.

BACKGROUND OF THE INVENTION

The present invention relates to a drop-on-demand ink-jet printing head for jetting ink, in the form of small droplets, from an ink reservoir so as to form printed dots on recording paper.

Drop-on-demand ink-jet printing head can be classified into three main types. The first type is a so-called bubble jet type in which a heater for instantaneously vaporizing ink is provided on the top end of a nozzle to thereby produce and jet an ink drop by expansion pressure created during vaporization. In the second type, a piezoelectric element provided in a vessel constituting an ink reservoir flexes or expands in accordance with an electrical signal applied thereto so as to is jet ink in the form of a drop by a force produced when the element expands. In the third type, a piezoelectric element is provided in an ink reservoir in opposition to a nozzle so as to jet an ink drop by dynamic pressure produced in a nozzle area upon expansion of the piezoelectric element.

As disclosed in Japanese Patent Publication No. Sho-60-8953, the above-mentioned third type drop-on-demand ink-jet printing head has a configuration wherein a plurality of nozzle apertures are formed in a wall of a vessel constituting an ink tank, and piezoelectric elements are disposed at the respective nozzle apertures matched in the direction of their expansion and contraction with each other.

In this printing head, a printing signal is applied to the piezoelectric elements so as to selectively actuate the piezoelectric elements to jet ink drops from the corresponding nozzles by the dynamic force produced when the piezoelectric elements are actuated to thereby form dots on printing paper.

In such a printing head, it is desirable that the efficiency in ink drop formation and the force of ink drop jetting are large. However, since the unit length of a piezoelectric element and the rate of expansion/contraction of the same per unit voltage are extremely small, it is necessary to apply a high voltage to in order to obtain sufficient jetting force for printing, and it is therefore necessary to construct a driving circuit and electric insulators so as to withstand such a high voltage.

In order to obtain a high jetting force, European Patent Unexamined Publication No. 372521 discloses a drop-on-demand ink-jet printing head in which a piezoelectric plate is fixedly attached to an elastic metal plate and is cut and divided corresponding to the arrangement of nozzle apertures, with one end of the piezoelectric plate being fixed to a frame while the other end thereof opposite to the nozzle apertures is a free end.

In this printing head, a driving signal is applied to the piezoelectric plate to thereby bend the elastic metal plate to store energy. In this state, the application of the driving signal is stopped to thereby release the elastic force stored in the elastic metal plate so that dynamic pressure is applied to ink, creating a repulsion force to thereby discharge the ink in the form of ink drops to the outside through the nozzle apertures.

However, there is a problem in that a high voltage has to be applied to the piezoelectric plate to bend the elastic metal plate to such an extent as to form ink drops.

SUMMARY OF THE INVENTION

It is an object of the present invention to solve the foregoing problems of the prior art.

It is another object of the present invention to provide a drop-on-demand ink-jet printing head with which ink drops can be produced at a low voltage and with a high energy efficiency.

In order to attain the foregoing objects, according to the present invention, a drop-on-demand ink-jet printing head is provided which comprises: an array of a plurality of piezoelectric elements arranged at regular intervals and fixed at their one ends to a base, the other ends of the respective piezoelectric elements being free ends which are disposed in opposition to respective nozzle apertures, the piezoelectric elements being formed by cutting, at predetermined width, a piezoelectric plate obtained by firing a lamination of paste-like piezoelectric material conductive material stacked alternately in layers; and ink reservoir portions formed between the nozzle apertures and the free ends of the piezoelectric elements.

In the printing head constructed according to the present invention, a piezoelectric plate is formed by firing a lamination of paste-like piezoelectric material and conductive material stacked alternately in layers and is cut at predetermined widths into pieces to thereby constitute the array of piezoelectric elements. Accordingly, even if a low voltage is selectively applied to the piezoelectric material layers constituting the respective piezoelectric elements to thereby drive the layers, the sum of the respective force components acts on ink, so that it is possible to produce enough dynamic pressure to jet the ink as ink drops through the corresponding nozzle apertures. Since the array of piezoelectric elements can be formed by cutting into strips the piezoelectric plate fixed to a base or the like, extremely small vibration elements can be produced with high working accuracy and with high efficiency.

DESCRIPTION OF THE PREFERRED EMBODIMENTS

Figure 1:
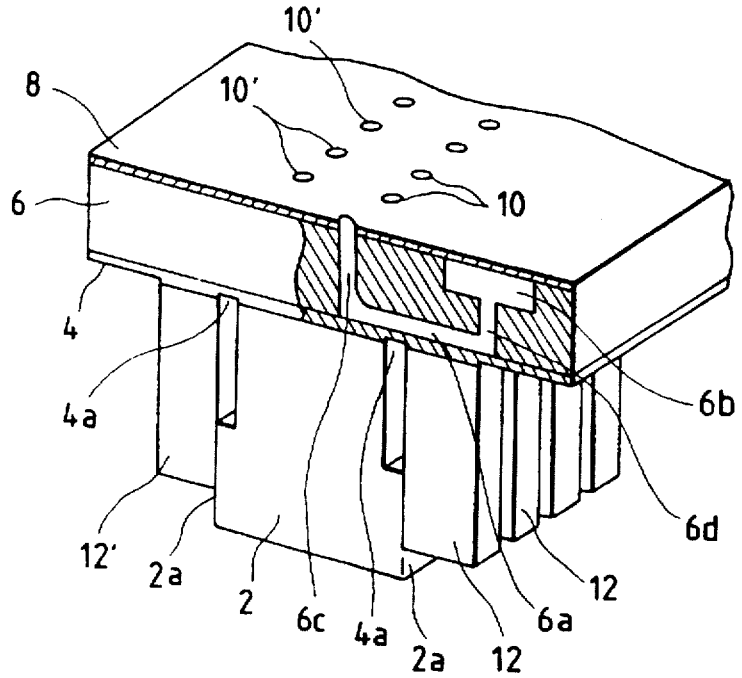
FIG. 1 is a perspective sectional view illustrating the structure of a main part of a drop-on-demand ink-jet printing head of a first type constructed in accordance with the present invention.
Figure 2:
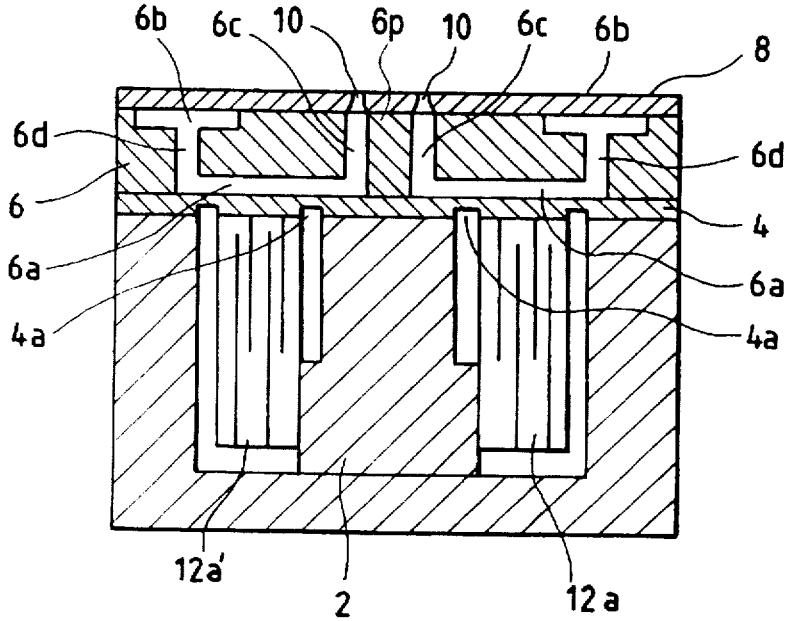
FIG. 2 is a sectional view illustrating the structure of a printing head according to the present invention.

FIGS. 1 and 2 depict a drop-on-demand ink-jet printing head of a first type according to the present invention. In the drawings, a base 2 has sidewise extended projection portions 2*a* and 2*a* at its one end portion, that is, at its lower portion in the drawings, so that piezoelectric vibrators 12 and 12' (which will be described later) are fixed to the projection portions 2*a* and 2*a*.

On the upper surface of the base 2 is fixed a vibration plate 4 for separating an ink reservoir and the piezoelectric vibrators 12. Concave portions 4*a* and 4*a* are formed in the vibration plate 4 in the vicinity of portions where the vibration plate 4 contacts the piezoelectric vibrators 12 so that the vibration plate 4 can respond easily to the vibration of the piezoelectric vibrators 12.

A spacer member 6, which acts also as a channel constituent member, is fixed to the surface of the vibration plate 4. In the spacer member 6, recess portions 6*a* constituting ink reservoirs in cooperation with the vibration plate 4 are provided in the areas opposite to the piezoelectric vibrators 12. In a nozzle plate 8 (which will be described later) recess portions 6*b* constituting ink supply channels are formed so that the recess portions 6*a* constituting the ink reservoirs, nozzle apertures and the recess portions 6*b* constituting the ink supply channels communicate with each other through respective penetration holes 6*c* and 6*d*. The nozzle plate 8 is fixed to the surface of the spacer member 6, and in the nozzle plate 8, a plurality of nozzle apertures 10 and 10' are formed so as to accord with the arrangement of the piezoelectric vibrators 12 and 12'. The respective openings of the recess portions 6*b* formed in the spacer member 6 are sealed by the nozzle plate 8 so as to form the ink supply channels. A partition plate 6*p* in the spacer 6 separates respective groups of ink reservoirs from one another.

The respective one end portions of the above-mentioned piezoelectric vibrators 12 and 12' are fixed to the vibration plate 4, and the respective other end portions of the same are fixed to the projection portions 2*a*.

FIGS. 3*a* to 3*f* illustrate a method of producing the above-mentioned vibrators.

Figure 3A:
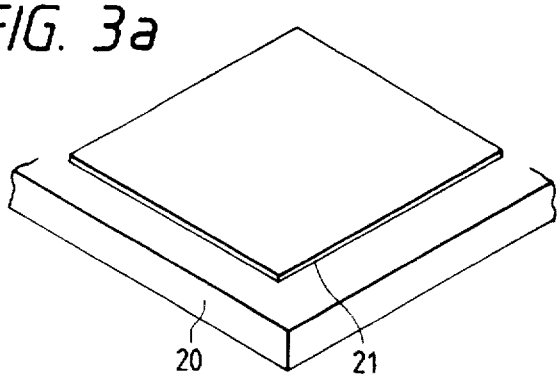
FIGS. 3*a* to 3*f* are explanatory diagrams illustrating steps of producing a piezoelectric vibrator.

A thin coating of a piezoelectric material in paste-like form, for example, a titanic-acid/zirconic-acid lead-system composite ceramic material, is applied on a surface plate 20 to thereby form a first piezoelectric material layer 21 (in FIG. 3*a*). A first conductive layer 22 is formed on the surface of the first piezoelectric material layer 21, while a part of the first piezoelectric material layer 21 is left as an exposed portion 21*a* (in FIG. 3*b*). Further, a thin coating of a piezoelectric material is applied on the respective surfaces of the conductive layer 22 and the exposed portion 21*a* of the first piezoelectric material layer 21 to thereby form a second piezoelectric material layer 23. A conductive layer 24 is further formed on the other surface of the layer 23 such that a part of the second piezoelectric material layer 23 is left as an exposed portion 23*a* that is diametrically opposed to the portion 21*a* (in FIG. 3*c*). The above steps are repeated a required number of times.

Figure 3B:
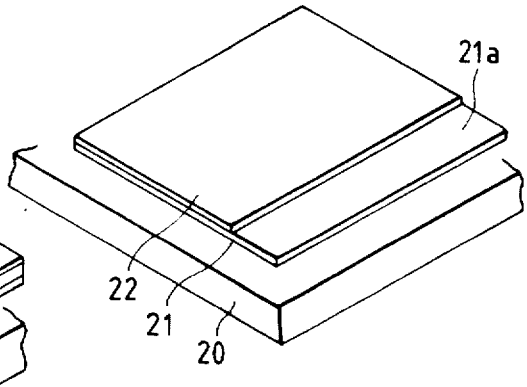
Figure 3C:
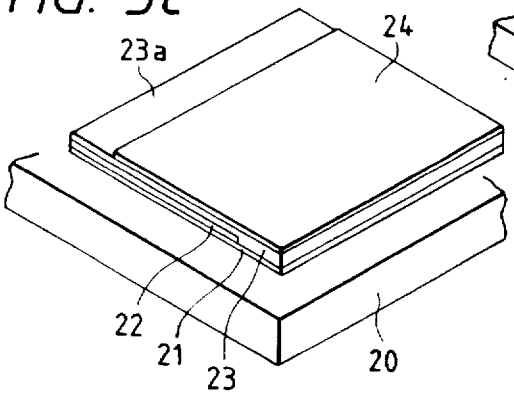
Figure 3D:
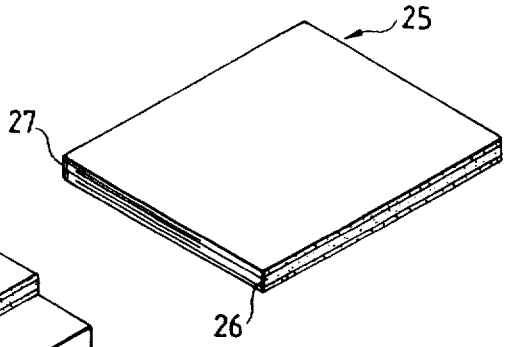
Figure 3E:
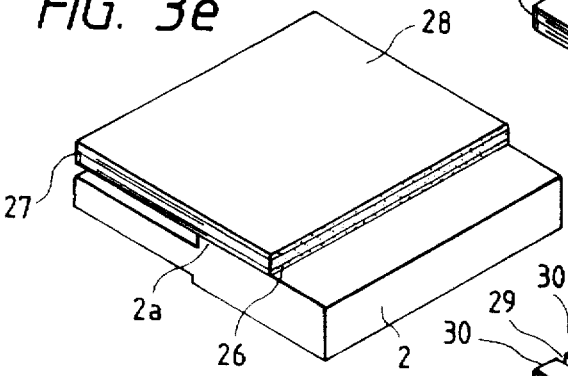

In the stage where a predetermined number of layers have been formed in the form of a lamination in such a manner as described above, the lamination is dried and fired under pressure at a temperature in a range of 1000° C. to 1200° C. for about an hour, thereby obtaining a plate-like ceramic member 25. One end portion of the ceramic member 25 where the conductive layer 24 is exposed is coated with a conductive paint to thereby form a collecting electrode 26, and the other end portion of the ceramic member 25 where the conductive layer 22 is exposed is coated with a conductive paint to thereby form a collecting electrode 27 (in FIG. 3*d*) to thereby form a piezoelectric plate 28. The thus-formed piezoelectric plate 28 is fixed onto the projection portion 2*a* of the base 2 through a conductive bonding agent (FIG. 3*e*). Then, the piezoelectric plate 28 is cut, by a diamond cutter or the like, in the vicinity of the surface of the base 2, to thereby divide it in predetermined widths into a plurality of vibrators 30 (in FIG. 3*f*).

Figure 3F:
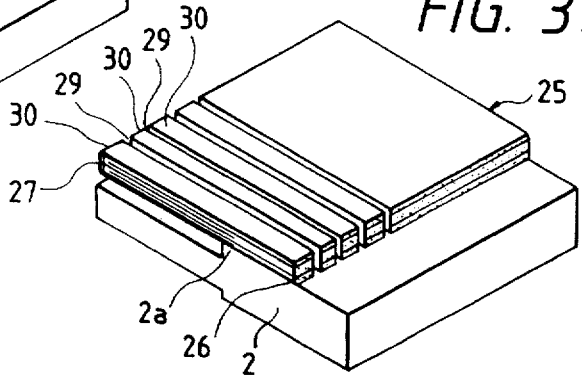
Figure 4:
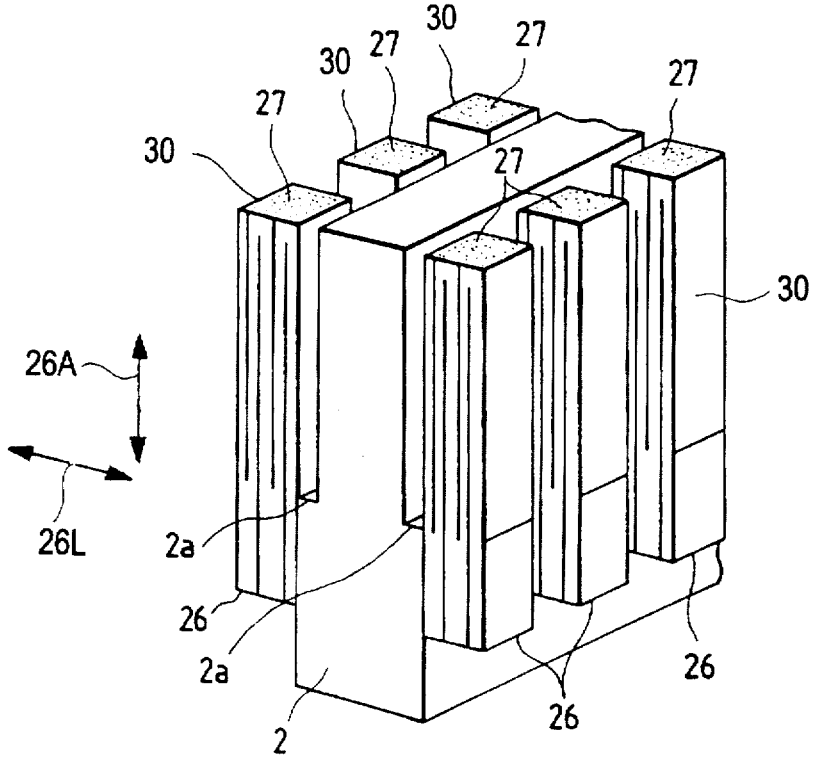
FIG. 4 is a perspective view illustrating the structure of a vibrator unit produced by the steps shown in FIGS. 3*a* to 3*f*.

Thus, there is formed an arrangement of the piezoelectric vibrators 30 (corresponding to the piezoelectric plate 12 and 12' in FIG. 1), the respective one-end portions of which are fixed to the base 2, and the other free end portions of which are separated by slits 29 produced by the above-mentioned cutting process. The steps shown in FIGS. 3*e* and 3*f* are also applied to the opposite surface of the base 2, whereupon a vibrator unit as shown in FIG. 4 is formed.

Individually separated conductive members are connected to the respective collecting electrodes 26 which are connected to the one-side electrodes of the respective piezoelectric vibrators 30, of the thus-arranged vibration unit, while a common conductive member is connected to the collecting electrodes 27 which are respectively connected to the otherside electrodes. Alternatively, in the case where the vibration plate 4 is made of a conductive material, the vibration plate 4 is employed as the common conductive member.

If an electric signal of about 30 V is applied between the conductive members, the piezoelectric vibrators 30, to which the signal is selectively applied through their proper conductive members, expand in their axial directions 26A as a result of application of the actuating voltage to the respective piezoelectric material layers.

In this embodiment, since the electrodes are disposed parallel to each other in the expansion direction, the energy efficiency is high in comparison with those of other vibration modes. FIG. 4 shows the lamination direction 26L extending perpendicularly to the axial, expansion direction 26A.

The vibration plate 4 (see FIG. 1) fixed to the top ends of the piezoelectric vibrators 12 expands so that the vibration plate 4 contacting the piezoelectric vibrators 12 is displaced in the direction toward the recess portions 6*a* constituting the ink reservoirs, thereby compressing the ink reservoirs. The ink on which the pressure is exerted through the volume reduction of the ink reservoirs reaches the corresponding nozzle apertures 10 through the penetrating holes 6*c* and jets out as ink drops.

When the application of the signal is stopped, the piezoelectric vibrators 12 contract so that the vibration plate 4 also returns to its initial position. Consequently, the ink reservoir is expanded to the volume at the time when no signal is applied, so that the ink in the recess portion 6*b* flows into the recess portion 6*a* through the penetrating hole 6*d*, thereby preparing for the next ink drop generation.

According to this embodiment, the ink reservoirs compressed by the piezoelectric vibrators 12 and 12' are connected with the nozzle apertures 10 and 10' through ink channels such as the penetrating holes 6*c* and 6*c*, so that it is possible to shorten the distance between the two arrays of nozzle apertures 10 and 10' independently of the distance between the two arrays of piezoelectric elements 12 and 12'.

Figure 5:
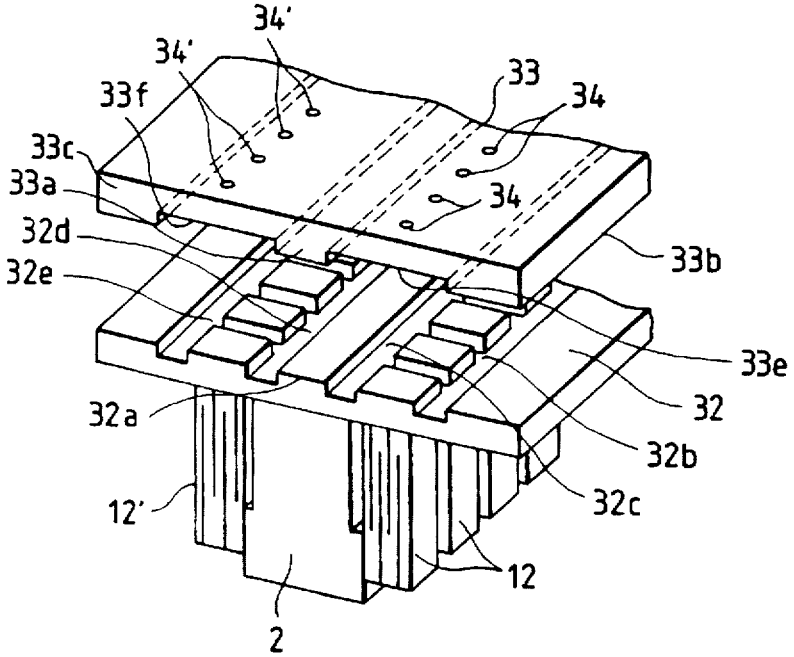
FIG. 5 is a perspective view illustrating another embodiment of a drop-on-demand ink-jet printing head of the first type according to the present invention, in which a nozzle plate is removed.

In FIG. 5, which shows a second embodiment, reference numeral 32 represents a vibration plate, on the surface of which a ridge strip portion 32*a* is formed so as to separate the array of piezoelectric vibrators 12 from the array of piezoelectric vibrators 12', and groove portions 32*b* to 32*e* are formed to surround the respective top ends of the piezoelectric vibrators 12 and 12'.

The reference numeral 33 represents a nozzle plate in which nozzle apertures 34 and 34' are formed so as to accord with the arrangement of the piezoelectric vibrators 12 and 12', and ridge portions 33*a* to 33*c* are formed in the opposite side and central portions, respectively, so as to form recess portions 33*e* and 33*f* constituting ink reservoirs on the top ends of the piezoelectric vibrators 12 and 12' when the nozzle plate 33 is fixed to the vibration plate 32.

In this embodiment, if the piezoelectric vibrators 12 and 12' axially expand when an electric signal of about 30 V is applied, the vibration plate 32 fixed to the top ends of the piezoelectric vibrators 12 and 12' expands so that the vibration plate 32 contacting the piezoelectric vibrators is displaced toward the recess portions 33*e* and 33*f* of the nozzle plate 33, thereby compressing the ink therein through the vibration plate 32. The compressed ink jets out as ink drops through the nozzle apertures 34 and 34' formed in the other surface.

If the application of the signal is stopped, the piezoelectric vibrators 12 contract to their initial states to make the vibration plate 32 return to its initial position, so that the ink reservoir is expanded to the volume at the time of application of no signal. Consequently, the ink in the recess portions 32*b* to 32*e* flows into the recess portions 33*e* and 33*f* constituting ink reservoirs, thereby preparing for the next ink drop generation. According to this embodiment, no spacer member is necessary, and it is possible to simplify the assembling process.

Figure 6A:
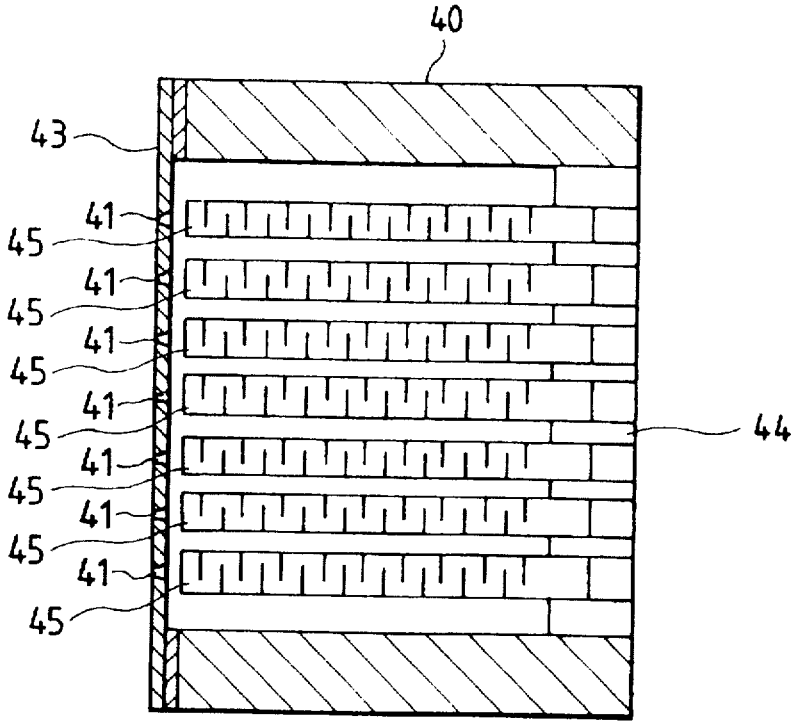
FIGS. 6*a* and 6*b* are sectional views illustrating the structure of a drop-on-demand ink-jet printing head of a second embodiment according to the present invention.
Figure 6B:
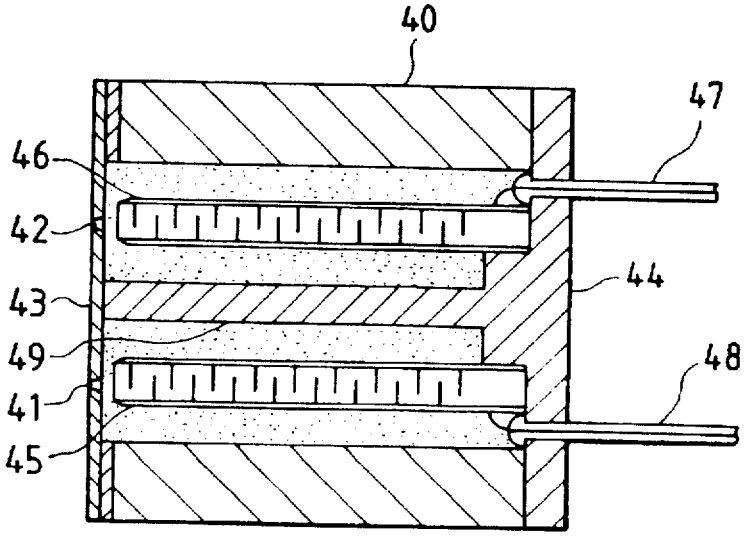

In FIGS. 6*a* and 6*b*, which show an embodiment of the drop-on-demand ink-jet printing head of a second type according to the present invention, reference numeral 40 represents a cylindrical body composed of an electrically isolating material such as ceramics. The cylindrical body 40 has openings at its opposite ends. A nozzle plate 43 having nozzle apertures 41 and 42 is fixed on the one end of the cylindrical body 40 through a bonding agent, while a base plate 44 having piezoelectric element arrays (which will be described later) is fixed on the other end of the cylindrical body 40. Piezoelectric elements 45 and 46 of these piezoelectric element arrays are disposed so that the direction of expansion/contraction is opposite to the nozzle apertures 41 and 42 when electric signals from lines 47 and 48 are applied thereto. In addition, a partition plate 49 reaching the nozzle plate 43 is provided on the base plate 44.

In the thus-arranged printing head using arrays of piezoelectric elements, if electric signals are applied to the piezoelectric elements 45 and 46 through the lines 47 and 48 and a common electrode, the base plate 44 in this embodiment, the piezoelectric elements 45 and 46 expand in the direction of lamination so that the free ends of the piezoelectric elements 45 and 46 press ink toward the nozzle apertures 41 and 42, whereby the dynamically pressurized ink enters the nozzle apertures 41 and 42 and is jetted out as ink drops to thereby form dots on the printing paper.

When the application of the electric signals is stopped, the piezoelectric elements 45 and 46 contract into their original states, so that ink flows into the space between the nozzle plate 43 and the piezoelectric elements 45 and 46 to thereby prepare for the next ink drop generation.

Figure 7A:
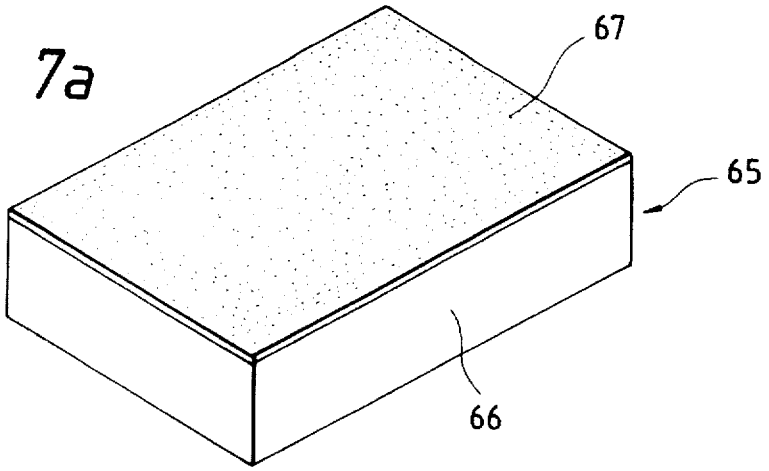
FIGS. 7*a* and 7*b* are perspective views illustrating a method of producing an array of piezoelectric elements for use in the apparatus of FIG. 6.
Figure 7B:
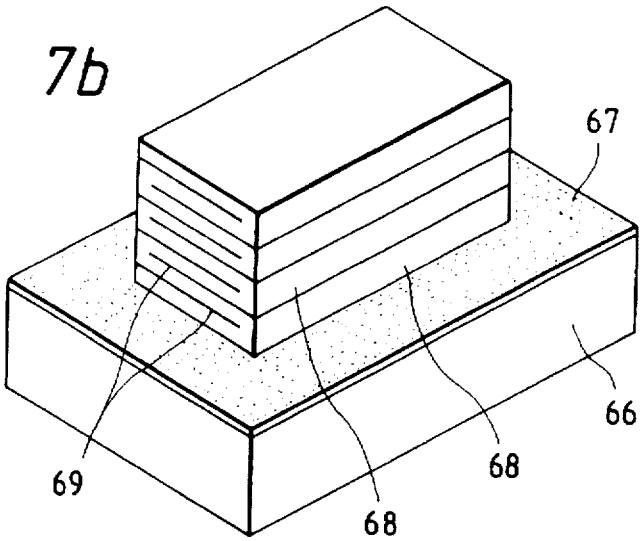

FIGS. 7*a* and 7*b* show an embodiment of the inventive method of producing an array of piezoelectric elements. In FIG. 7*a*, reference numeral 65 represents a member in which the surface of a base plate 66 formed of a plate-like ceramic material is coated with a conductive material 67, which acts also as bonding agent. The surface of the conductive material 67 of this base plate 66 is coated with piezoelectric materials 68 and conductive materials 69 alternately in layers in the same manner as in the above-mentioned case (FIGS. 3*a* to 3*c*).

In the stage where a lamination of a predetermined number of layers has been dried to a state in which it can be fired, the base plate 66, the piezoelectric materials 68 and the conductive materials 69 are fired integrally as they are. Consequently, the base plate 66, the piezoelectric materials 68 and the conductive materials 69 are bonded by the conductive layers 67 and formed integrally (in FIG. 7*b*).

Subsequent to the firing operation, by forming slits at a constant distance as mentioned above, it is possible to integrally form piezoelectric element arrays on the base plate 66 in which the conductive layers 67 are formed.

Figure 8:
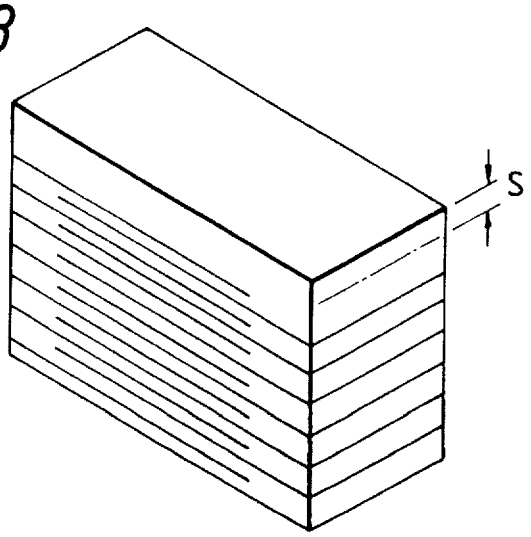
FIG. 8 is a perspective view illustrating another embodiment of the array of piezoelectric elements.

Moreover, since the jetting ability of liquid drops jetted from the nozzle apertures depends on the distance between the nozzle plate and the free end surface of the piezoelectric element, the value of the distance can be adjusted by grinding the part forming the free end of the piezoelectric element when the piezoelectric element is formed. In order to facilitate such adjustment, a layer S which has no relationship to piezoelectric action may be formed of a piezoelectric or electrode material in advance on the free end surface, as shown in FIG. 8, so that the layer S may be ground to carry out the adjustment working.

Figure 9:
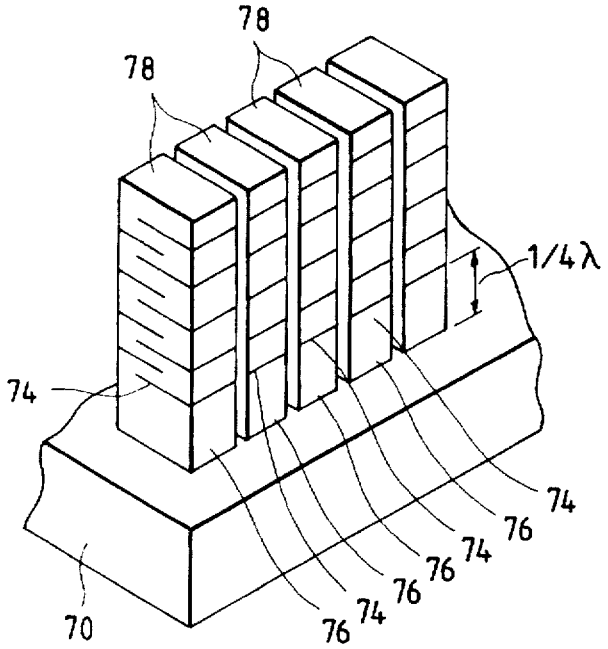
FIGS. 9 to 11 are perspective views illustrating a method of attaching an array of piezoelectric elements onto a base plate.

FIG. 9 shows another embodiment of the array of piezoelectric elements according to the present invention. As seen in the drawing, inactive portions layers 76 of a length corresponding to a quarter of the vibration wavelength are formed between a base plate 70 and electrodes 74, which are the closest to the base plate 70, when piezoelectric elements 78 are fixed on the base plate 70 to form a printing head assembly. Consequently, of the elastic waves produced within the piezoelectric elements, elastic waves which have propagated to the base plate 70 are reflected on the surface of the base plate 70 because the acoustic impedance of the base plate 70 is different from that of the piezoelectric material so that the elastic waves return to the free ends while their phases are reversed by reciprocal passage through the inactive portions 76, thereby contributing to the ink drop generation.

Figure 10:
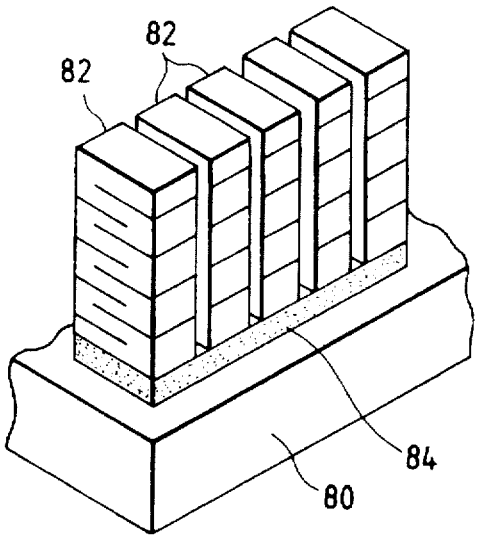

FIG. 10 shows another embodiment of the array of piezoelectric elements according to the present invention. In this embodiment, a layer 84 of a substance of a high viscoelastic property is interposed between a base plate 80 and an array of piezoelectric elements 82 which are assembled as a printing head, or the piezoelectric elements are fixed to the base plate through a bonding agent which can maintain a high viscoelastic property upon completion of solidification, thereby forming a bonding agent layer.

According to this embodiment, since elastic waves propagating to the base plate 80 are attenuated by the viscoelastic layer 84, not only is it possible to reduce the interference of reflected waves from the base plate 80 to thereby stabilize the generation and jet of ink drops, but also it is possible to absorb the strain produced between the base plate 80 and the piezoelectric elements 82 at the time of expansion of the piezoelectric elements 82 by the viscoelastic layer 84 so as to prevent the piezoelectric elements 82 from being broken off.

On the other hand, since the piezoelectric elements expand not only in their axial direction but also in their width direction at the time of discharging ink, a large stress acts on the bonding surface thereof with the base plate.

Figure 11:
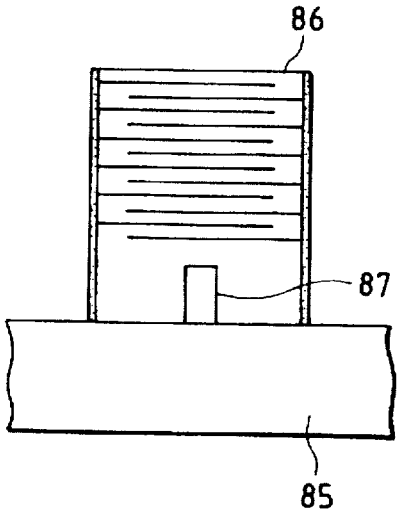

FIG. 11 illustrate a positive measure against such a problem. As seen in the drawing, a shallow slit 87 is formed in an array of piezoelectric elements 86 on the side thereof contacting a base plate 85 so that the slit 87 can absorb the strain in the width direction. Thus, it is possible to prevent problems such as breaking off of the piezoelectric elements 86.

Figure 12:
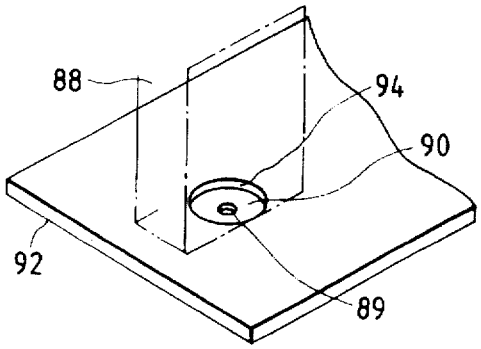
FIGS. 12 to 14 are perspective views illustrating an embodiment of the nozzle plate for use in the printing head according to the present invention.

FIG. 12 shows an embodiment of the above-mentioned nozzle plate. In this embodiment, a nozzle plate 92 is constituted in a manner so that a nozzle aperture 89 is formed in the area opposite to the free end of each piezoelectric element 88, and an elliptical recess portion 90 is formed so as to surround the nozzle aperture 89.

According to this nozzle plate, if a signal is applied so that the free end of the piezoelectric element 88 expands toward the nozzle plate 92, ink present in the elliptical recess portion 90 is surrounded by a wall 94 of the recess portion 90 and covered from the back with the free end of the piezoelectric element 88 upon reception of dynamic pressure caused by elastic waves from the piezoelectric element 88. Its escape path being blocked, the ink concentratedly flows into the nozzle aperture 89. It is therefore possible to jet ink drops effectively with as low applied voltage as possible.

Figure 13:
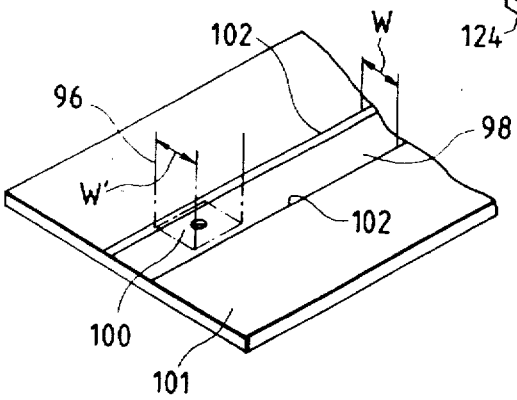

FIG. 13 shows another embodiment of the nozzle plate. In the nozzle plate of this embodiment, a groove 98 having a slightly larger width W than the width W' of each piezoelectric element 96 passes a nozzle aperture 100.

According to this embodiment, if the piezoelectric element 96 is disposed close enough for its top end to enter the groove 98, elastic waves generated by the piezoelectric element 96 apply a dynamic pressure to ink in the groove 98. Then, since the ink in the groove 98 is surrounded by the walls 102 of the groove 98 and covered from the back with the free end of the piezoelectric element 96, the ink in the groove 98 jets out from the nozzle aperture 100 effectively. When the driving signal is stopped to thereby allow the piezoelectric element 96 to contract, ink flows from a portion not opposite the piezoelectric element in the groove 98 into an area opposite the piezoelectric element, thereby preparing for the next printing operation. Although the width of the groove 98 is larger than that of the piezoelectric element 96 in this embodiment so that the top end of the piezoelectric element 96 can enter the groove 98, the width W of the groove 98 may be made smaller than the width W' of the piezoelectric element 96 to provide a space between the top end of the piezoelectric element 96 and the surface of the nozzle plate 101. In this case, ink receiving elastic waves from the piezoelectric element 96 is prevented from expanding in the direction parallel to the nozzle plate 101 by the walls 102 of the groove 98, so that it is possible to produce ink drops effectively.

Figure 14:
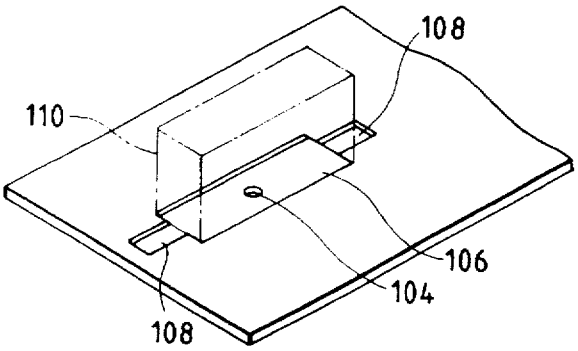

FIG. 14 shows another embodiment of the nozzle plate. In the nozzle plate of this embodiment, a recess portion 106 having substantially the same shape as a piezoelectric element is formed so as to surround a nozzle aperture 104, and grooves 108 which are shallower than the recess portion 106 are formed in both sides of the recess portion 106.

According to this embodiment, in the same manner as in FIG. 12, when a piezoelectric element 110 expands, that is, when elastic waves are produced, dynamic pressure is applied to the ink in the recess portion 106 from the piezoelectric element 110. Surrounded by the wall of the recess portion 106 and the free end surface of the piezoelectric element 110, the ink jets out through the nozzle aperture 104 effectively. On the other hand, when the piezoelectric element contracts, ink flows from the grooves 108 to the recess portion 106 suddenly, preparing for the next ink drop generation.

Figure 15:
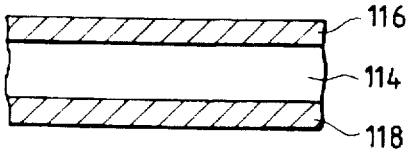
FIG. 15 is a sectional view illustrating an example of a material base plate suitable for producing, by etching, the nozzle plate shown in FIGS. 12 to 14.

In order to form such a nozzle plate, a plate having a three-layer structure in which nickel plates 116 and 118 are pressed and fixed onto the opposite side of a copper plate 114, as shown in FIG. 15, is prepared, and then a recess portion and grooves are formed by an etching agent which dissolves only the nickel plates 116 and 118 selectively. Thus, it is possible to form a recess portion having an even bottom portion.

For example, to form a plate having such a three-layer structure of a copper plate 114 having a thickness of 50 μm sandwiched between nickel plates 116 and 118 each having a thickness of 25 μm, it is possible to dissolve all of the nickel plate on one surface of the copper plate at the same time as a recess portion is formed on the other surface, so that it is possible to form a nozzle plate having a groove of 50 μm in width defining a nozzle aperture.

Figure 16:
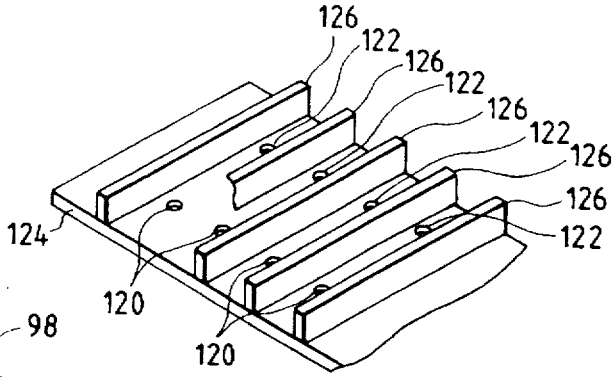
FIG. 16 is a perspective view illustrating another embodiment of the nozzle plate.
Figure 17:
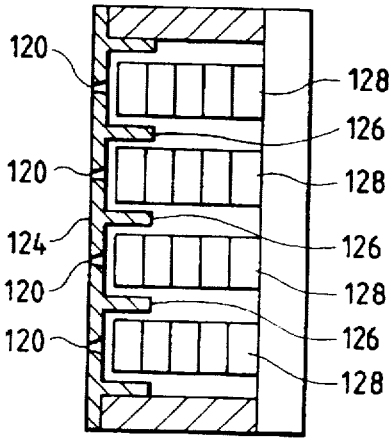
FIG. 17 is a sectional view illustrating a printing head using the nozzle plate shown in FIG. 16.

FIGS. 16 and 17 show another embodiment of the nozzle plate. In the nozzle plate of this embodiment, because of screening the side of piezoelectric elements 128 dynamic pressure caused upon application of a signal to the piezoelectric elements is prevented from propagating to other adjacent nozzle apertures by separation walls 126, so that it is possible to prevent unnecessary ink from flowing out.

Figure 18:
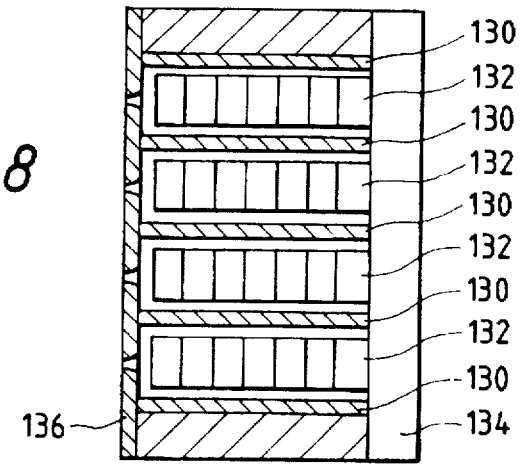
FIG. 18 is a sectional view illustrating another embodiment of the state of attaching a nozzle plate.

FIG. 18 shows another embodiment according to the present invention. In this embodiment, struts 130 are formed between piezoelectric elements 132 constituting a piezoelectric element array, and are fixed to a base plate 134 on which the array of piezoelectric elements is mounted, or on a nozzle plate 136.

According to this embodiment, not only it is possible to control the distance between nozzle plate 136 and each of the piezoelectric elements 132 by use of the struts 130, but also it is possible to prevent dynamic pressure from propagating between adjacent piezoelectric elements 132.

Figure 19:
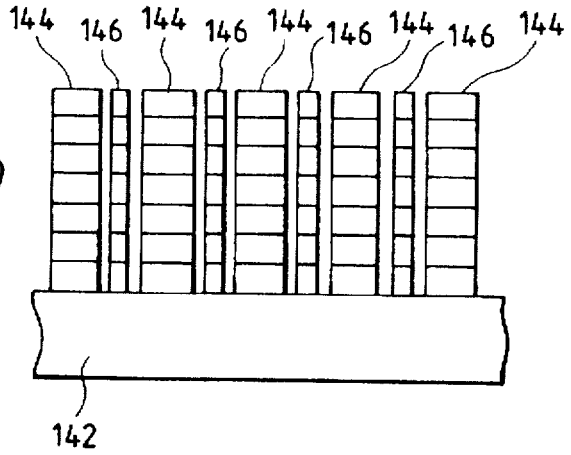
FIG. 19 is a plan view illustrating an embodiment in which support members for supporting a nozzle plate are formed by use of a piezoelectric plate at the same time.

FIG. 19 shows another configuration of the struts 130 shown in FIG. 18. In this embodiment, the foregoing rectangular-prism-like piezoelectric ceramic material is fixed on a base plate 142, and then the ceramic material is cut and separated into portions 144 to form piezoelectric elements and portions 146 to form struts, the portions to form piezoelectric elements being ground a little on the side of their free ends.

Figure 20:
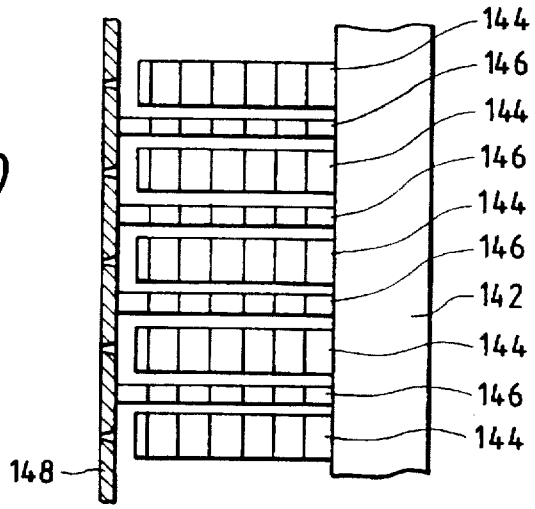
FIG. 20 is a sectional view illustrating a printing head using a piezoelectric element array shown in FIG. 19.

In the thus-formed array of piezoelectric elements, a nozzle plate 148 is disposed so as to be in contact with the portions 146 to form struts as shown in FIG. 20, so that it is possible to make the gap between the nozzle plate and the free end of each of the piezoelectric elements be a predetermined size. Accordingly to this embodiment, not only is it possible to form struts in the process of forming an array of piezoelectric elements, but also it is possible to simplify the assembling work because of eliminating the step of attaching the strut members to the base plate.

Figure 21A:
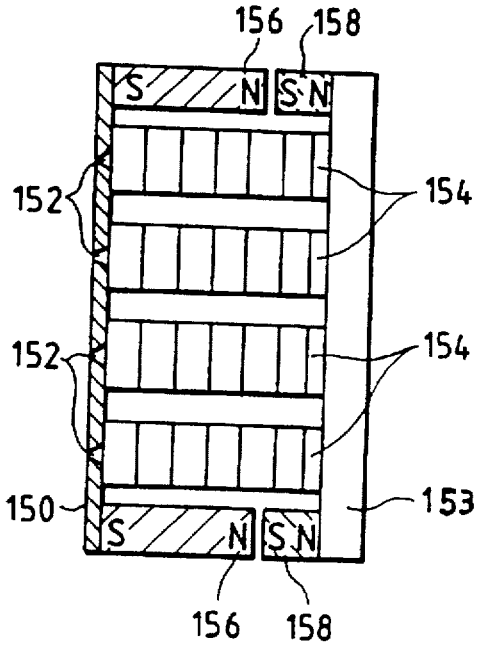
FIGS. 21*a* and 21*b* are sectional views respectively illustrating another state of attaching a nozzle plate and the operation thereof at the time of forming an ink drop.
Figure 21B:
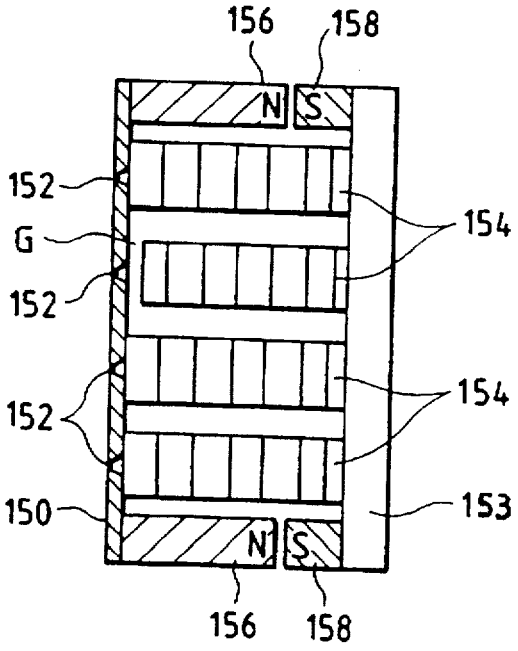

FIGS. 21*a* and 21*b* show another embodiment of the inventive method of fixing a nozzle plate. In this embodiment, a nozzle plate 150 through which nozzle apertures 152 are bored is urged against a base plate 53 by magnets 156 and 158 or springs so as to be always in contact with the free ends of piezoelectric elements 154.

In this embodiment, a voltage in the direction of contraction is applied to the piezoelectric elements 154 which are in the position of ink drop formation. Consequently, a gap G is produced between the nozzle plate 150 and the free end surfaces of the piezoelectric elements 154 (in FIG. 21*b*), so that ink flows into this gap. Then, when the application of the signal is stopped, or if a signal in the direction of expansion is applied, the free ends of the piezoelectric elements 154 expand toward the nozzle plate 150.

In this process of expansion, the ink in the gap G is pressed to the nozzle aperture 152 and jetted out to the outside as an ink drop. Since the nozzle aperture 152 which has no relationship to the formation of an ink drop is made to elastically contact with the free end of the piezoelectric element 154, dynamic pressure from the adjacent piezoelectric elements does not act on the nozzle aperture 152 so that the ink can be prevented from leaking.

Figure 22A:
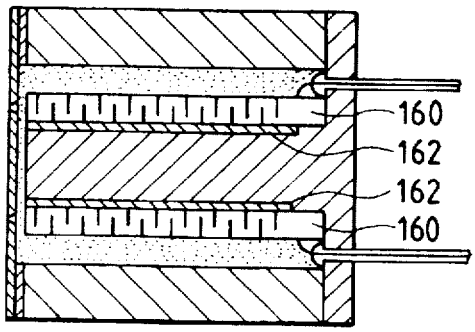
FIGS. 22*a* to 22*c* are diagrams respectively illustrating an embodiment in which an elastic material such as bonding agent fills space portions of piezoelectric elements.
Figure 22B:
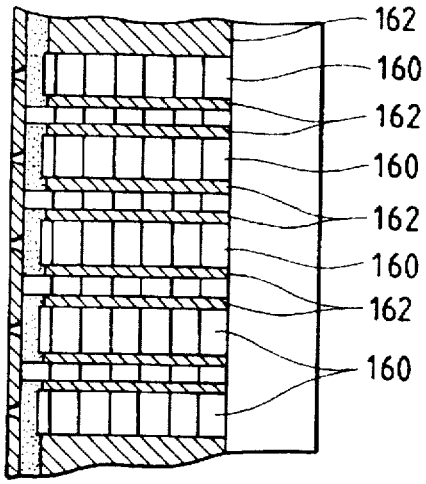
Figure 22C:
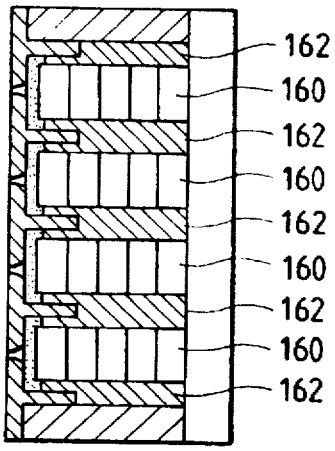

Although a space enabling ink to flow is formed between adjacent piezoelectric element arrays and between the piezoelectric element arrays and the base plate in the above-mentioned embodiment, a bonding agent or resin 162 having low viscosity and high elasticity at the time of solidification, for example, an epoxy-system bonding agent, ultraviolet-ray setting resin such as G11 or G31 made by Asahi Chemical Industry Co., Ltd., or ultraviolet-ray setting silicon rubber such as TUV6000 or TUV 602 made by Toshiba Silicon Co., Ltd., is injected and solidified in portions except for the free end surfaces of the piezoelectric elements 160, as shown in FIGS. 22*a* to 22*c*, to thereby reduce the influence of the piezoelectric elements 160 to vibration as much as possible, so that it is possible to reinforce the mechanical strength of the piezoelectric elements 160 and to better ensure the electric insulation of the conductive layers.

Figure 23A:
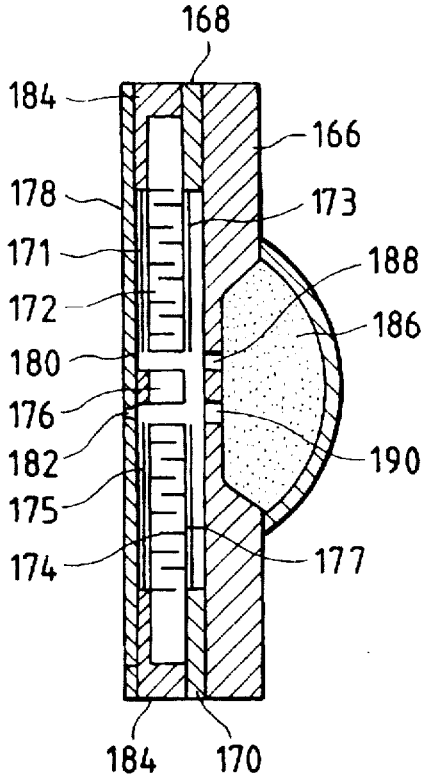
FIGS. 23*a* and 23*b* are sectional views illustrating the ink-jet printing head of a third type according to the present invention.
Figure 23B:
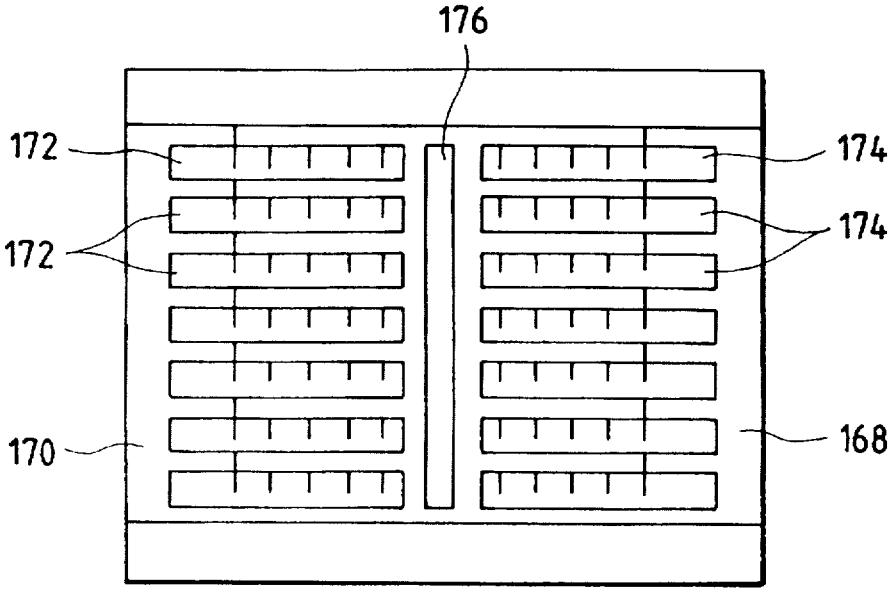

FIGS. 23*a* and 23*b* show an embodiment of a drop-on-demand ink-jet printing head of a third type according to the present invention. In this embodiment, piezoelectric elements 172 and 174 are arrayed on a base plate 166 through conductive spacers 168 and 170 so that the direction of lamination of the piezoelectric elements is parallel to the base plate 166 and the free ends of the piezoelectric elements are separated from each other by a predetermined space. In this space, a separation wall member 176 is disposed with predetermined gaps from the respective free ends of the piezoelectric elements 172 and 174.

In a nozzle plate 178, nozzle apertures 180 and 182 are formed in opposition to the gaps between the separation wall member 176 and the respective free ends of the piezoelectric elements 172 and 174, and fixed at predetermined intervals through a spacer 184. An ink tank 186 communicates with the nozzle apertures 180 and 182 through communication holes 188 and 190.

Figure 24A:
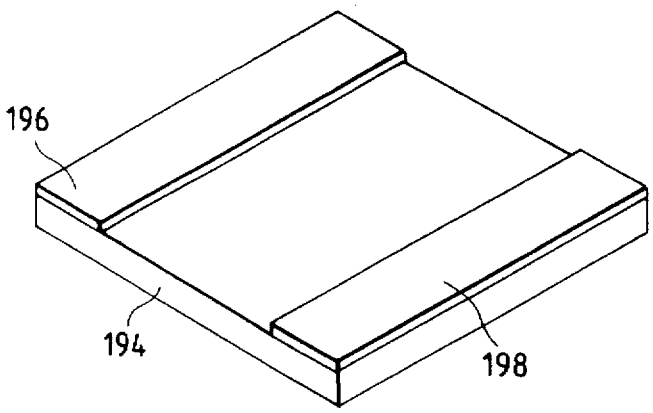
FIGS. 24*a* to 24*c* are explanatory diagrams illustrating steps of forming the array of piezoelectric elements for the apparatus shown in FIGS. 23*a* to 23*b;*
Figure 24B:
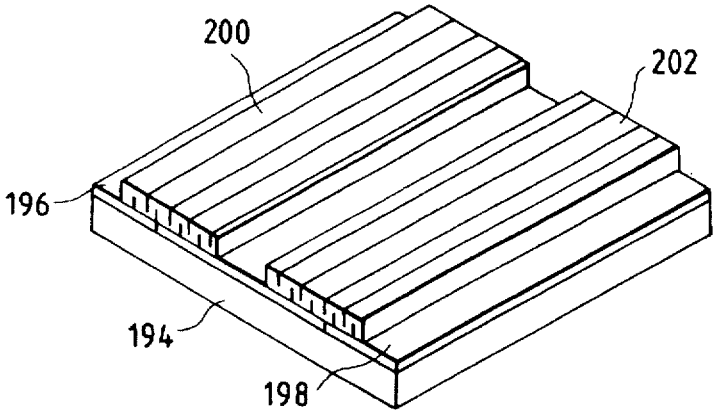
Figure 24C:
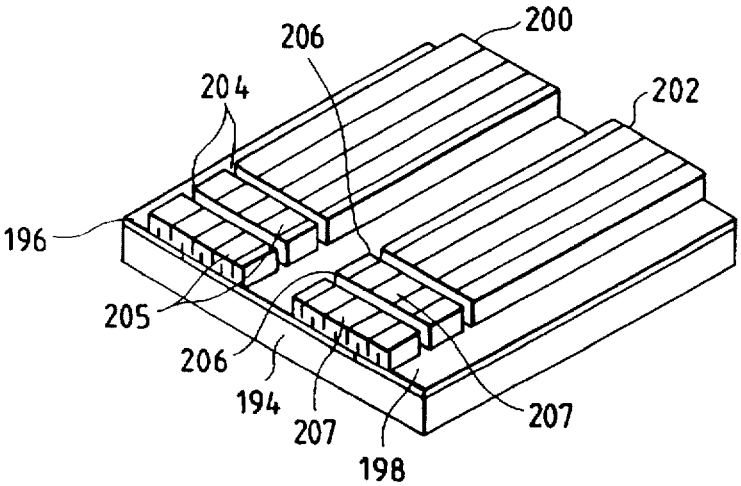

FIGS. 24*a* to 24*c* depict a method of forming the above-mentioned piezoelectric element array. As seen in these drawings, spacer members 196 and 198 are fixed to a member 194 corresponding to the base plate 166 in FIGS. 23*a* and 23*b* through a bonding agent (in FIG. 24*a*). In this state, piezoelectric element plates 200 and 202, which are the same as those shown in FIG. 3, are fixed at their one ends through a conductive bonding agent so that the conductive layers on their one side are on the side of the spacers 196 and 198 (FIG. 24*b*). Next, slits 204 and 206 are formed in the thickness of the piezoelectric element plates at predetermined intervals extending parallel to the direction of lamination of the piezoelectric element plates 200 and 202 (FIG. 24*c*). Consequently, piezoelectric elements 205 and 207 separated from each other by the slits 204 and 206 are formed on the base plate 194 in a manner so that electrodes on one side are commonly connected to each other by the spacers 196 and 198.

In this embodiment, if a signal is applied to the piezoelectric elements 172 and 174 to form dots (FIG. 23*a* and 23*b*), a voltage is applied to the respective piezoelectric layers of the piezoelectric elements 172 and 174 through conductive layers 171 and 173 of the piezoelectric element 172 and conductive layers 175 and 177 of the piezoelectric element 174 at the same time, so that the sum of expansion force of the respective piezoelectric layers acts on the free ends. Accordingly, the ink between the separation wall member 176 and the free end of the piezoelectric element 174 is pressed out from the space and jets out to the outside from the nozzle aperture 182. When the application of the voltage to the piezoelectric element 174 is stopped, the piezoelectric element contracts, so that ink flows from the ink tank 186 into the space, thereby preparing for the next dot generation.

Figure 25A:
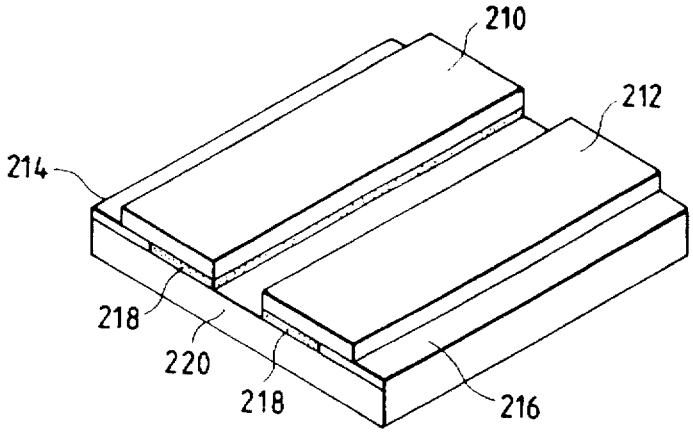
FIGS. 25*a* and 25*b* are explanatory diagrams illustrating another embodiment of the inventive method of forming the array of piezoelectric elements.
Figure 25B:
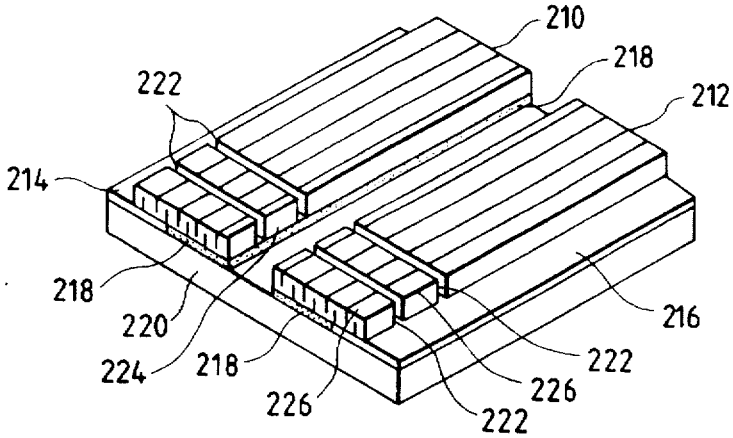

Although piezoelectric elements are fixed in the form of a cantilever shape by a spacer in a printing head shown in FIGS. 23*a* and 23*b*, as shown in FIG. 25*a*, portions of piezoelectric element plates 210 and 212 projecting over spacers 214 and 216 are fixed to a base plate 220 by a bonding agent or resin 218 having a low viscosity and a high elasticity at the time of solidification, for example, an epoxy-system bonding agent, ultraviolet-ray hardening resin such as G11 and G31 made by Asahi Chemical Industry Co., Ltd., or ultraviolet-ray setting silicon rubber such as TUV6000 or TUV 602 made by Toshiba Silicon Co., Ltd. In this state, slits 222 are formed at predetermined intervals using a diamond cutter or the like, thereby forming piezoelectric elements 224 and 226, with their one-side surfaces being bonded to the base plate 220 (FIG. 25*b*).

According to such a method, it is possible to absorb the vibration produced at the time of forming the slits to thereby prevent the piezoelectric element plates from being broken off.

Figure 26:
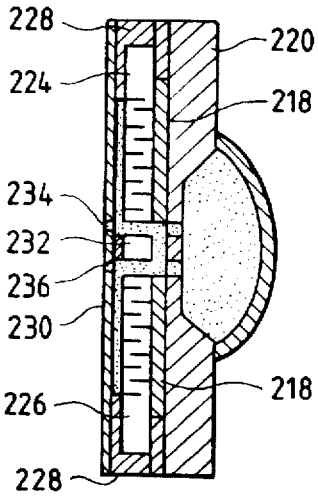
FIG. 26 is a sectional view illustrating a printing head using the array of piezoelectric elements produced by the process shown in FIGS. 25*a* and 25*b;*

As shown in FIG. 26, a nozzle plate 230 is attached through a spacer 228 to the base plate 220 on which the thus-formed piezoelectric element arrays are mounted, thereby providing a printing head the same as that shown in FIG. 23*a*. Reference numeral 232 in FIG. 26 represents a partition member disposed between the facing surfaces of the piezoelectric elements, and 234 and 236 represent nozzle apertures.

In this embodiment, if a voltage is applied to the piezoelectric element 224 opposite the nozzle aperture 234 to form a dot, the piezoelectric element 224 expands while transforming the bonding agent 218 elastically, pressing the ink between the partition member 232 and the free end thereof, thereby jetting the ink from the nozzle aperture 234 as an ink drop. Of course, since the force produced by the piezoelectric element 224 is extremely large, the effect of the viscosity of the bonding agent 218 is extremely small, so that the energy produced as the transformation of the piezoelectric element is not absorbed by the bonding agent.

Figure 27A:
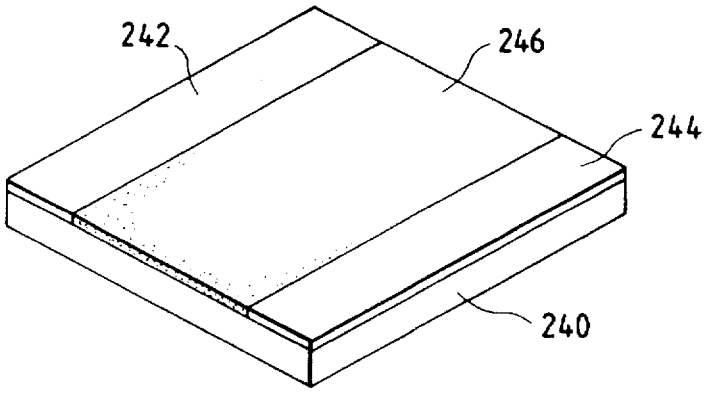
FIGS. 27*a* to 27*c* are explanatory diagram illustrating another method of forming an optimum array of piezoelectric elements for the printing head shown in FIGS. 23*a* and 24*b;*
Figure 27B:
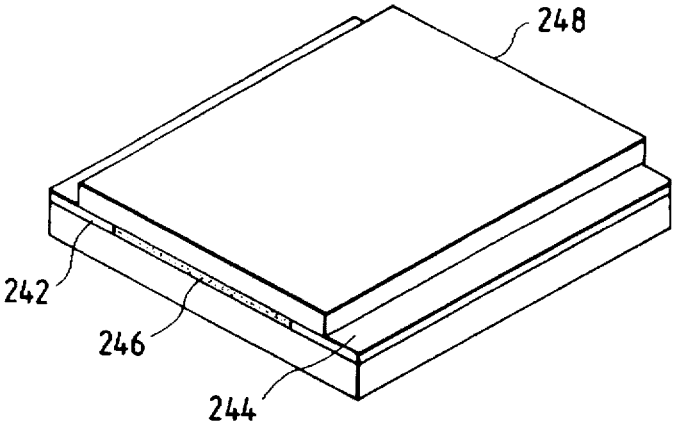
Figure 27C:
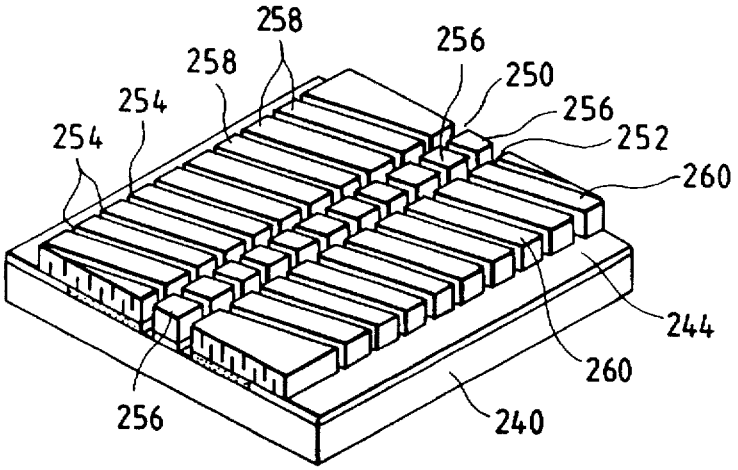

FIGS. 27*a* to 27*c* illustrate another embodiment of the inventive method of forming a piezoelectric element array, in which spacers 242 and 244 are fixed to the opposite ends of a base plate 240, and a bonding agent 246 having low viscosity and high elasticity at the time of solidification flows into a grooved portion formed by the spacers 242 and 244 (FIG. 27*a*). A piezoelectric element plate 248 the same as the mentioned above is fixed to the spacers 242 and 244 with a conductive bonding agent and to the base plate 240 with a bonding agent 246 (FIG. 27*b*). When the bonding agent has solidified, two slits 250 and 252 separated from each other and extending to the outer surface of the base plate 240 are formed. Next, slits 254 parallel in the oblique direction are formed at predetermined intervals so that the two ends of the piezoelectric element plates separated by the slits 250 and 252 are displaced by one-half pitch (FIG. 27*c*).

Consequently, the free ends of the piezoelectric elements opposite to each other with the partition member 256 therebetween are displaced by one-half pitch, so that it is possible to print dots formed by the one-side piezoelectric elements 260 between dots formed by the other side piezoelectric elements 258.

Figure 28:
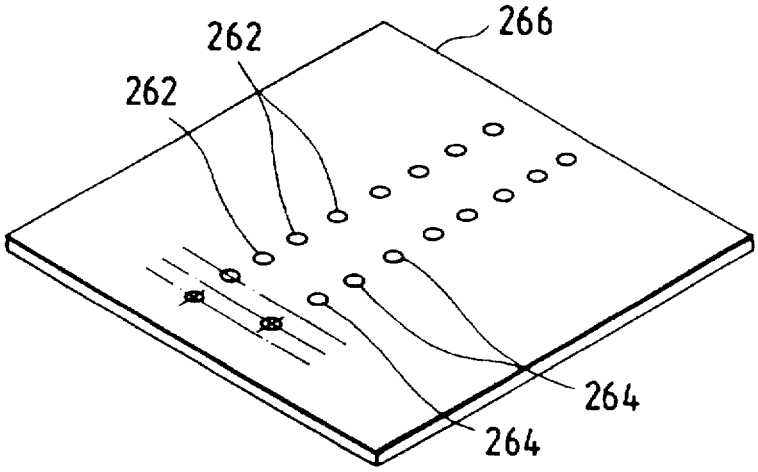
FIG. 28 is a perspective view illustrating an embodiment of a nozzle plate suitable for the array of piezoelectric elements shown in FIG. 27*c;*

A nozzle plate 266 is prepared for the thus-arranged piezoelectric elements, with the nozzle plate 266 arranged by displacing nozzle apertures 262 in the first column and nozzle apertures 264 in the second column from each other by one-half pitch, as shown in FIG. 28.

Figure 29:
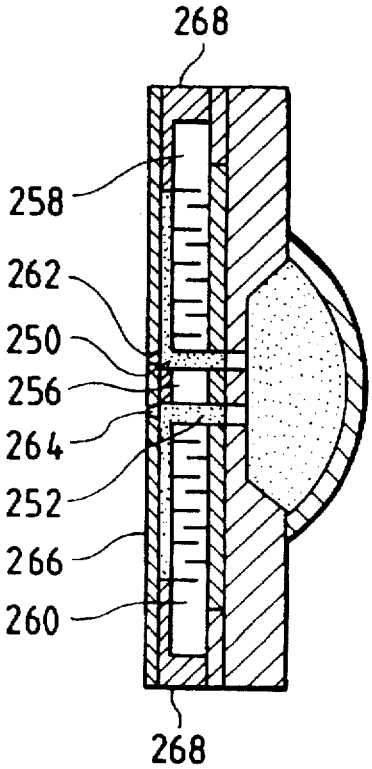
FIG. 29 is a sectional view illustrating a printing head employing the piezoelectric element array shown in FIG. 27*c* and the nozzle plate shown in FIG. 28.

The nozzle plate 266 is attached to the base plate 240 (FIG. 27*c*) through a spacer 268 as shown in FIG. 29, thereby constituting a printing head.

In this embodiment, the slits 250 and 252 form ink channels, and a portion 256 separated by these slits 250 and 252 functions as a partition member, so that when a signal is applied to the piezoelectric elements 258 and 260, ink drops are jetting out from the nozzle apertures 262 and 264.

According to this embodiment, since a partition member and ink channels can be formed together with the formation of piezoelectric elements at the same time, it is possible to simplify the process of production, and it is also possible to improve the density of dots without making the width of the piezoelectric elements narrow.

In the printing heads of the second and third types, the entire large force produced by the thickness-wise vibration of piezoelectric elements is used, and ink is jetted out by the pressure of the piezoelectric elements, so that it is possible to produce ink drops effectively not only in the case of using a normal ink but also in the case of using an extremely high viscous ink such as hot melt ink.

Figure 30A:
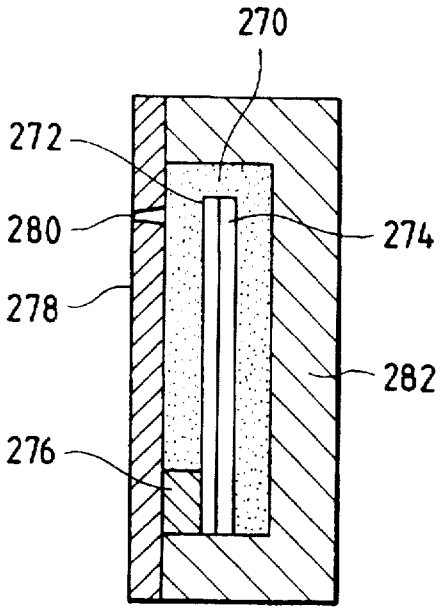
FIGS. 30*a* and 30*b* are sectional views illustrating an embodiment of the printing head of a fourth type according to the present invention.
Figure 30B:
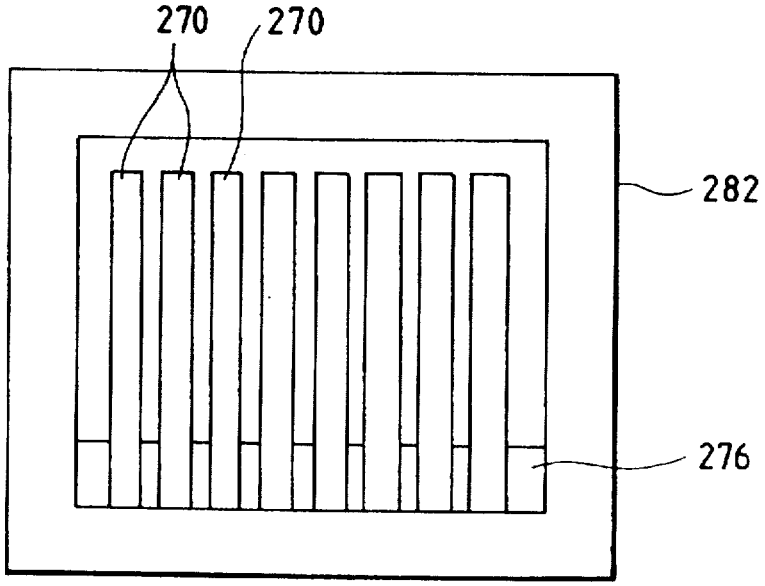

FIGS. 30*a* and 30*b* show an embodiment of a fourth type according to the present invention. In the drawings, the reference numeral 270 represents a lead piece composed of a high elastic spring member 272 and a piezoelectric element 274 (which will be described later) laminated on the elastic spring member 272, one end of the lead piece 270 being fixed to a spacer 276 so that the lead piece 270 faces a nozzle plate 278, the other end of the lead piece 270 being formed as a free end so that the lead piece can vibrate flexibly. Reference numeral 278 represents a nozzle plate in which nozzle apertures 280 are formed at positions opposite the free ends of respective ones of the lead pieces 270. The nozzle plate 278 is fixed to a base member 282 which also functions as a housing.

Figure 31A:
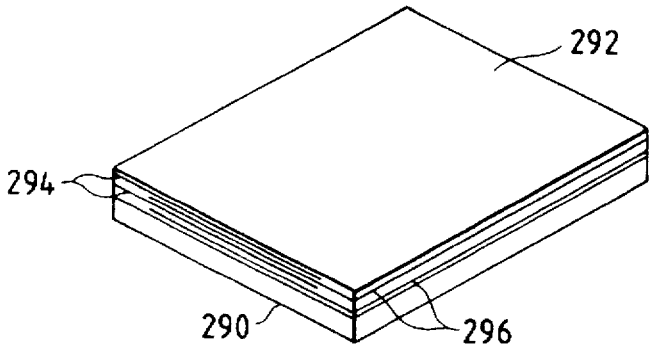
FIGS. 31*a* to 31*c* are explanatory diagrams illustrating a first embodiment of a method of producing lead pieces suitable for the printing head shown in FIGS. 30*a* and 30*b*.
Figure 31B:
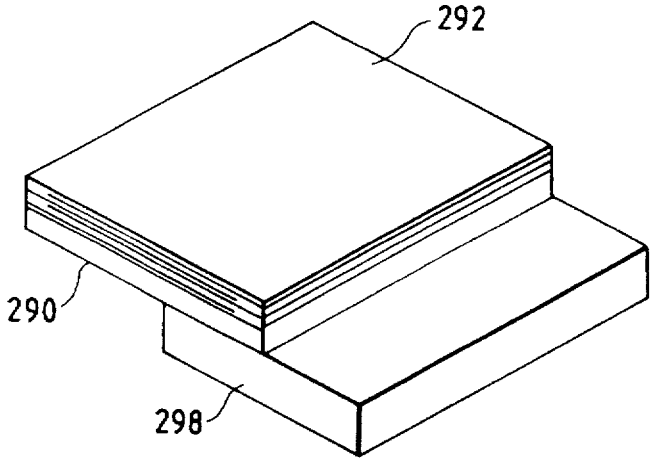
Figure 31C:
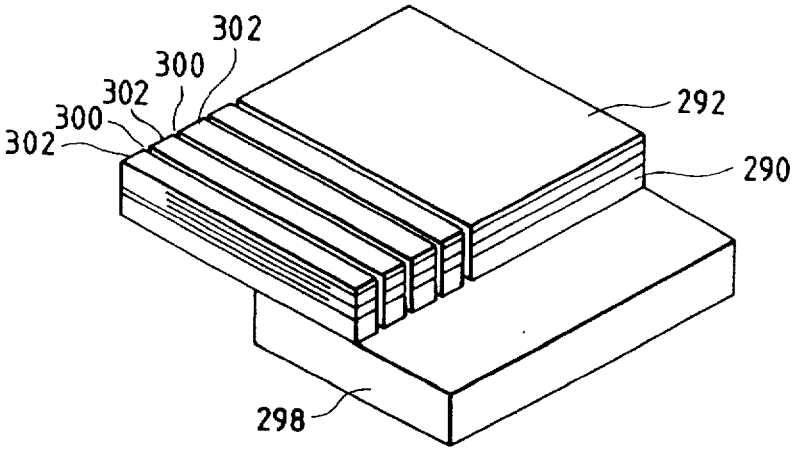

FIGS. 31*a* to 31*c* illustrate a process of producing the above-mentioned lead piece, in which a piezoelectric element plate 292 produced by the above-mentioned process is cemented through a bonding agent to one surface of a plate 290 composed of a high elastic metal plate or ceramics constituting the above-mentioned spring plate 272 so that conductive layers 294 and 296 thereof are parallel to the plate 292, thereby constituting a plate.

The thus integrally formed structure constituted by the piezoelectric element plate 292 and the plate 290 is fixed to a spacer member 298 on its one side (FIG. 31*b*), and slits 300 are formed at regular intervals using a diamond cutter or the like to thereby strip lead pieces 302 with their one ends fixed to the spacer 298 and with their other ends made free (FIG. 31*c*).

Accordingly to this embodiment, if an electric signal in the direction of contraction of the piezoelectric element plate 292 is applied to the conductive layers 294 and 296, the free ends of the lead pieces 302 are bent toward the piezoelectric element plate 292 against the elasticity of the plate 290.

In this state, when the application of the electric signal is stopped, the elastic force stored in the plate 290 is released so that the lead pieces 302 spring and return to their original positions.

Consequently, ink between the nozzle plate 278 and the lead pieces 270 (FIG. 30*a*) is pressed out toward the nozzle aperture 280 and jetted out of the nozzle apertures 280 as an ink drop.

Although the piezoelectric element plate 292 produced in advance is cemented to the plate 290 in the embodiment shown in FIG. 31, high heat-proof ceramics may be used for the plate 290, so that it is possible to omit the cementing process if the piezoelectric element plate is formed on the above-mentioned process (in FIG. 3) thereon.

Figure 32A:
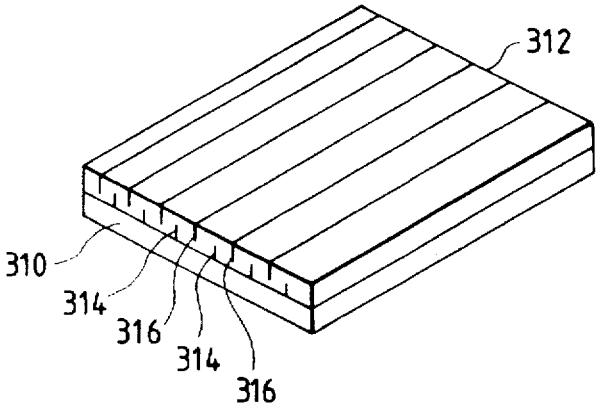
FIGS. 32*a* to 32*c* are explanatory diagrams illustrating a second embodiment of the method of producing lead pieces suitable for the printing head shown in FIGS. 30*a* and 30*b*.
Figure 32B:
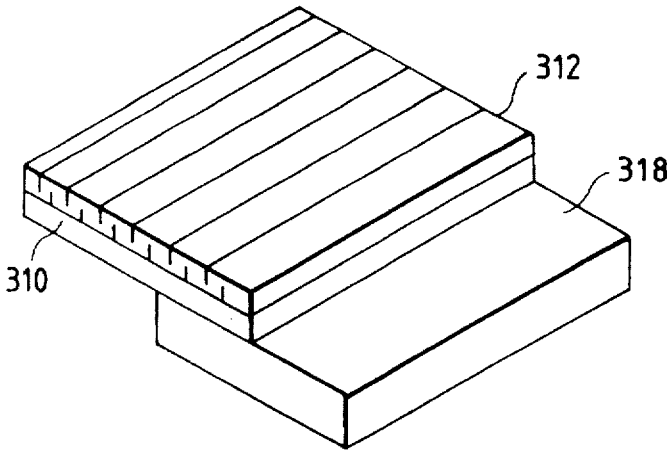
Figure 32C:
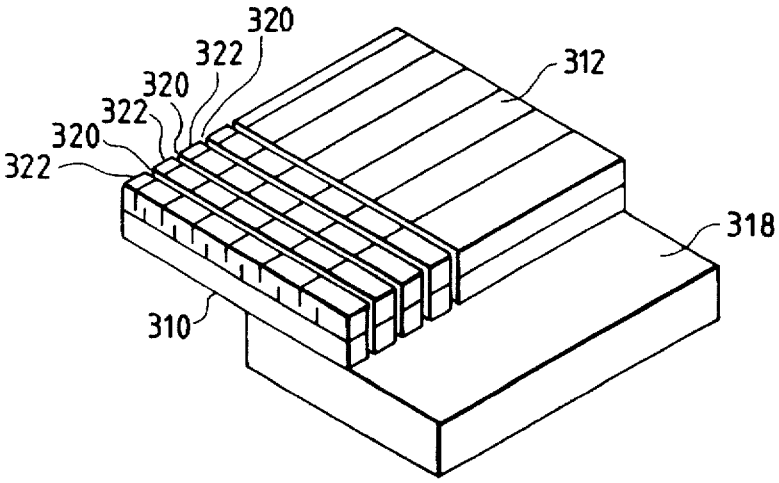

FIGS. 32*a* to 32*c* show another embodiment of producing a lead piece, in which a piezoelectric element plate 312 produced by the above-mentioned process is cemented to one surface of a plate 310 composed of an elastic metal plate or ceramics and constituting the above-mentioned spring plate 272 with a bonding agent so that conductive layers 314 and 316 of the piezoelectric element plate 312 are perpendicular to the plate 310 (FIG. 32*a*).

The piezoelectric element plate 312 and the plate 310 arranged integrally is fixed at its one end portion to a spacer member 318 (in FIG. 32*b*). Then, slits 320 are formed in the piezoelectric element plate 312 and the plate 310 at regular intervals using a diamond cutter or the like, so as to form stripped lead pieces 322, one ends of which are fixed to the spacer 318 and the other ends of which are free (FIG. 32*c*).

According to this embodiment, if an electric signal in the direction of contraction of the poezoelectric element plate 312 is applied to conductive layers 314 and 316, the respective free ends of the lead pieces 302 are bent toward the piezoeletric element plate 312 against the elasticity of the plate 310.

In this state, when the application of the electric signal is stopped, the elastic force stored in the plate 310 is released so that the lead pieces 322 spring and return to their original positions.

What is claimed is:

1. A drop on-demand ink jet printing head, comprising:

a structure having a plurality of nozzle apertures; and a plurality of piezoelectric elements connected to said structure and aligned respectively with said plurality of nozzle apertures wherein:

said piezoelectric elements each comprises laminated multiple piezoelectric layers and multiple conductive layers and comprises end faces that extend substantially parallel to a lamination direction of said piezoelectric layers and said conductive layers;

the lamination direction of said piezoelectric layers and said conductive layers coincides with a direction perpendicular to a main vibrating direction of said piezoelectric elements; and said piezoelectric elements each comprises vibration-inducing end electrodes disposed on the end faces of each of said piezoelectric elements.

2. A printing head as claimed in claim 1, wherein said structure comprises:

a nozzle plate comprising said nozzle apertures;

a spacer for forming ink storage areas interposed between said nozzle plate and said piezoelectric elements; and a vibration plate interposed between said spacer and said piezoelectric elements.

3. A printing head as claimed in claim 2, wherein said structure further comprises a base plate to which said piezoelectric elements are fixed.

4. A printing head as claimed in claim 3, wherein:

said spacer comprises a partition portion that extends between and thereby partitions the ink storage areas into a first group and a second group of the ink storage areas in correspondence with said nozzle apertures; and said base plate is aligned with said partition portion.

5. A printing head as claimed in claim 4, wherein:

said nozzle apertures are aligned to form a plurality of nozzle arrays; and said base plate is aligned with said partition portion of said spacer between said nozzle arrays.

6. A printing head as claimed in claim 2, wherein ink is stored in the ink storage areas to be ejected through said nozzle apertures in a direction that coincides with the main vibrating direction of said piezoelectric elements.

7. A drop on-demand ink jet printing head, comprising:

a structure having a plurality of nozzle apertures; and a plurality of piezoelectric elements connected to said structure and aligned respectively with said plurality of nozzle apertures;

wherein:

said structure comprises a base plate to which said piezoelectric elements are each fixed at one end thereof, another end of each of said piezoelectric elements being a free end;

said piezoelectric elements each comprises laminated multiple piezoelectric layers and multiple conductive layers;

a lamination direction of said piezoelectric layers and said conductive layers coincides with a direction perpendicular to a main vibrating direction of said piezoelectric elements; and the free end of each of said piezoelectric elements is vibratable in the main vibrating direction.

8. A drop on-demand ink jet printing head, comprising:

a structure having a plurality of nozzle apertures;

a plurality of piezoelectric elements aligned with said plurality of nozzle apertures, respectively;

a vibration plate interposed between said structure and said piezoelectric elements and extending in a given plane; and interconnections between said structure, said piezoelectric elements and said vibration plate; wherein:

said piezoelectric elements each comprises laminated multiple piezoelectric layers and multiple conductive layers;

a lamination direction of said piezoelectric layers and said conductive layers coincides with a direction perpendicular to a main vibrating direction of said piezoelectric elements; and an axial direction extending lengthwise through each of said piezoelectric elements is substantially perpendicular to the plane of said vibration plate.

* * * * *

UNITED STATES PATENT AND TRADEMARK OFFICE

CERTIFICATE OF CORRECTION

PATENT NO. : 5,894,317
DATED : April 13, 1999
INVENTOR(S) : Minoru Usui et al.

It is certified that error appears in the above-identified patent and that said Letters Patent is hereby corrected as shown below:

Title page,
Item [30], Foreign Application Priority Data, delete "2-4074" and substitute -- 2-43787 --.

Signed and Sealed this

Fourteenth Day of February, 2006

JON W. DUDAS
*Director of the United States Patent and Trademark Office*